US010064257B2

(12) United States Patent
Jiang et al.

(10) Patent No.: US 10,064,257 B2
(45) Date of Patent: Aug. 28, 2018

(54) METHOD AND ARRANGEMENT FOR MONITORING OF LIGHTING SYSTEMS, AND A MONITORED LIGHTING INSTALLATION

(71) Applicant: PHILIPS LIGHTING HOLDING B.V., Eindhoven (NL)

(72) Inventors: Xiaobo Jiang, Eindhoven (NL); Fulong Ma, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/519,996

(22) PCT Filed: Oct. 28, 2015

(86) PCT No.: PCT/EP2015/074938

§ 371 (c)(1),
(2) Date: Apr. 18, 2017

(87) PCT Pub. No.: WO2016/066667

PCT Pub. Date: May 6, 2016

(65) Prior Publication Data

US 2017/0318648 A1 Nov. 2, 2017

(30) Foreign Application Priority Data

Oct. 28, 2014 (WO) ..... PCT/CN2014/089655
Dec. 2, 2014 (EP) ..... 14195801

(51) Int. Cl.
*H05B 37/02* (2006.01)
*H05B 37/03* (2006.01)

(52) U.S. Cl.
CPC ..... *H05B 37/0245* (2013.01); *H05B 37/03* (2013.01)

(58) Field of Classification Search
CPC ..... H05B 37/0245; H05B 37/03
USPC ..... 315/291
See application file for complete search history.

(56) References Cited

U.S. PATENT DOCUMENTS

2002/0130806 A1 9/2002 Taylor, Jr. et al.
2004/0002792 A1 1/2004 Hoffknecht
2009/0212965 A1* 8/2009 Becattini ..... H02H 3/14 340/660
2012/0194352 A1* 8/2012 Ellis ..... H05B 37/0272 340/907
2013/0057158 A1 3/2013 Josefowicz et al.
2013/0257289 A1* 10/2013 VanWagoner ..... H05B 37/0209 315/152

(Continued)

FOREIGN PATENT DOCUMENTS

WO WO2007031891 A1 3/2007
WO WO2013098722 A1 7/2013
WO WO2014033558A2 A2 3/2014

*Primary Examiner* — Dylan White

(57) ABSTRACT

A method and a system are provided for monitoring a lighting system. Physical location information is received with respect to each lighting unit of the system. Supply voltage information is also received with respect to each lighting unit. Based on the physical location of each lighting unit and the supply voltage information, power network information is derived to identify cable routes between the lighting units and the locations of lighting cabinets along the cable routes.

15 Claims, 7 Drawing Sheets

(56) References Cited

U.S. PATENT DOCUMENTS

2015/0249409 A1* 9/2015 Nakajima ..... H02P 6/18
318/400.15

* cited by examiner

METHOD AND ARRANGEMENT FOR MONITORING OF LIGHTING SYSTEMS, AND A MONITORED LIGHTING INSTALLATION

CROSS-REFERENCE TO PRIOR APPLICATIONS

This application is the U.S. National Phase application under 35 U.S.C. § 371 of International Application No. PCT/EP2015/074938, filed on Oct. 28, 2015, which claims the benefit of European Patent Application No. 14195801.7, filed on Dec. 2, 2014 and Chinese Patent Application No. PCT/CN2014/089655, filed on Oct. 28, 2014. These applications are hereby incorporated by reference herein.

FIELD OF THE INVENTION

This invention relates to the monitoring of lighting systems, in particular for the purpose of asset management of a lighting system.

BACKGROUND OF THE INVENTION

The invention is of particular interest for lighting systems which cover a large area, for example road lighting networks.

FIG. 1 shows a typical lighting control system, and shows the topology of the control network. The network has a local controller in a cabinet 10 which controls all the control nodes (i.e. lighting units) 16 along a cable. The local controller communicates with the back end 12. The locations of the cables and cabinets are known and there is a correspondence between the physical configuration and the control topology. Thus, once the central controller 10 has been commissioned, the assets (cabinets and cables) can be easily commissioned and managed.

FIG. 2 shows how an individual lighting system is controlled. There is no local controller in a cabinet. Instead, each node (i.e. light unit) has an individual controller, and they are under the control of one or several central controllers 12. The power is nevertheless delivered from an associated cabinet and cables extending from the cabinet. In the system of FIG. 2, it is not known where the cabinet is, nor is the cable path known. From a network point of view, all that can be observed at the central controller 12 is the number of discrete nodes.

Lighting control systems are evolving towards individual control systems as shown in FIG. 2.

For the individual lighting control system of FIG. 2, there may in fact be a few central controllers, but equally there may be only one controller, even for thousands of lighting units 16 (each of which can be considered as a separate control node). The network topology is no longer dictated by a fixed power cable arrangement associated with each cabinet 10 as in the example of FIG. 1.

Thus, the cable and cabinet information is not available in straightforward manner to the back end 12. The back end for example only has information relating to the individual lighting units, and all of the lighting units are identified as discrete points. The back end does not have knowledge of how the lighting units are physically connected, for example the cable routes between lighting units, or the locations of cabinets which control strings of lighting units.

The end users, for example road lighting bureaus, nevertheless have a responsibility to maintain these non-lighting assets, and ensure their correct functioning. To provide the end user with knowledge of the cable and cabinet locations and configurations, it becomes necessary for the system commissioner to cross-check the street construction design, and add cable and cabinet asset information manually.

There is a need to provide automated collection and management of these assets of a lighting system.

WO 2014/033558 discloses a system which uses voltage measurement to determine the location of luminaires along a track, for commissioning purposes. However, this method assumes that the location of the track is itself known and the purpose is to find the position of the luminaires within the known grid.

SUMMARY OF THE INVENTION

The invention is defined by the claims.

According to an aspect of the invention, there is provided a method of monitoring a lighting system which comprises a plurality of lighting units positioned along at least a supply cable, wherein the method comprises:

obtaining physical location information in respect of each lighting unit;

receiving supply voltage information in respect of each lighting unit; and based on the physical location of each lighting unit and the supply voltage information, deriving power network information which identifies the cable routes between the lighting units.

The invention provides a method (and system) which enables gathering of the lighting system configuration information. With supply voltage measurement and location information (such as GPS) in respect of each lighting unit, approximate the way in which the lighting units are physically connected, and the length of the cables can be derived. With this information, management of these assets is facilitated. In the event of lighting unit failure or failure of other assets within the system (such as the cables), it becomes possible quickly to give fault isolation information, to enable maintenance personnel to find fault locations.

The invention thus provides a lighting system asset management solution which is particularly suitable for systems which operate with distributed individual lighting control systems. It enables automatic information collection and management of non-lighting unit assets and enables fault isolation, for example distinguishing between lighting unit failure or power system failure.

The physical location information may be received from the lighting units themselves, or from other sources. For example, the lighting units may have a satellite positioning system for obtaining the physical location information. Similarly, the supply voltage information may not be received directly from the lighting units but may be received indirectly via an intermediate data source.

The supply voltage information is preferably sampled or otherwise measured in respect of each lighting unit at the same time. The timing can for example be controlled based on a satellite system (e.g. GPS) when such a system is used to provide the location information. The supply voltage information comprises supply voltage value or variations of supply voltage value, like root mean square voltage value, as mentioned below, or average absolute value of a plurality samples of voltage values etc.

The timing information enables all sampling information from different lighting units to be at the same point within an AC mains cycle. By taking a number of samples of the AC voltage, a root mean square (RMS) voltage value can be obtained to provide accurate voltage information.

The lighting units can all be controlled to be activated at the same time so that the supply voltage information is based on current being drawn from the supply cable at each lighting unit location. The sampling time of the RMS voltage at each location is preferably the same, with all of the lamps turned on. This simultaneous sampling takes account of the fact that if the grid voltage is always fluctuating, so that different sampling times would make the data less robust. Thus, simultaneous sampling is preferred for improved accuracy.

The lighting units could be clustered into a plurality of groups based on their physical locations, especially when the lighting units are positioned along a set of supply cables. Physical locations of lighting units could reflect number of supply cables. In each group, cable routes could be identified by analysis of supply voltage information of lighting units in that group, e.g. based on an analysis of the peaks and valleys of the supply voltages, or based on voltage drop of the supply voltages.

The lighting system may comprise a road lighting system. The network information may then be obtained taking account of a map which identifies the road locations. The cable routes follow the road locations, so this enables cable routes to be identified.

The system may comprise a set of lighting cabinets, each lighting cabinet supplying at least one respective set of lighting units along a supply cable extending from the lighting cabinet, and wherein deriving network information comprises identifying the lighting cabinet locations along the cable routes. Thus, an estimated location of lighting cabinets can also be derived.

The lighting cabinet locations may for example be obtained based on an analysis of the peaks and valleys of the supply voltages. The peaks will be at the locations of the lighting cabinets, and the valleys will be generally midway between cabinet locations. These valleys correspond to the ends of cables linked to the cabinets.

In one embodiment, the power network information includes the power network topology, such as the topology of cabinets, the branched cables which extend from the cabinets, and the lighting units connected by the cables. In a further embodiment, the power network information further includes the location, direction and length of power cables, the location of cabinets, the location of lighting units, and the location and power cable connection relationship between the lighting units and the cabinets.

The method may further comprise providing a diagnosis of faults in the lighting system. The method is thus suitable both for commissioning and maintenance of the lighting system.

A first example of fault is a cable failure. This can be based on a set of lighting units at the end of a cable failing.

A second example of fault is a lighting unit failure. This can be based on a lighting unit in a middle section of a cable failing.

A third example of fault is a lighting cabinet failure. This can be based on all lighting units along one or multiple cables from the lighting cabinet failing.

Once the type of fault has been identified the maintenance and repair is simplified.

A computer program product may be provided which comprises computer program code means, which is adapted to perform the method of the invention when said program is run on a computer. This computer program will operate at the back end server of the lighting system.

An example in accordance with another aspect of the invention provides a lighting system monitoring arrangement, for monitoring a lighting system which comprises a plurality of lighting units, wherein each lighting unit comprises a supply voltage monitoring system, wherein the monitoring arrangement comprises:

a receiving module for receiving a physical location of each lighting unit and for receiving supply voltage information from the supply voltage monitoring system; and a controller which is adapted to derive power network information, from the physical location information and the supply voltage information, which identifies the cable routes between the lighting units.

The lighting system may comprise a road lighting system, wherein the controller is adapted to take account of a map which identifies the road locations.

The lighting system may comprise a set of lighting cabinets, each lighting cabinet supplying a respective set of lighting units along a supply cable extending from the lighting cabinet, and the controller is adapted to derive network information which identifies the lighting cabinet locations along the cable routes by analysing the peaks and valleys of the supply voltage information.

The monitoring arrangement may be adapted to provide a diagnosis of:

a cable failure, based on a set of lighting units at the end of a cable failing; and/or a lighting unit failure, based on a lighting unit in a middle section of a cable failing and/or a lighting cabinet failure, based on all lighting units along one or multiple cables from a lighting cabinet failing.

The invention also provides a monitored lighting installation, comprising:

a lighting system comprising a plurality of lighting units, wherein each lighting unit comprises a satellite location system and a supply voltage measuring system; and a lighting system monitoring arrangement of the invention.

The lighting system may further comprise a set of lighting cabinets, each lighting cabinet supplying a respective set of lighting units along a supply cable extending from the lighting cabinet, and the controller is adapted to derive network information which identifies the lighting cabinet locations along the cable routes by analysing the peaks and valleys of the supply voltage information.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a method of monitoring a lighting system. Physical location information is received in respect of each lighting unit of the system. Supply voltage information is also received in respect of each lighting unit. Based on the physical location of each lighting unit and the supply voltage information, network information is derived which identifies cable routes between the lighting units and the locations of lighting cabinets along the cable routes.

The invention thus combines known physical locations of lighting units with locations along cable runs, as determined by voltage monitoring.

The lighting units are for example powered by individual cabinets, with each cabinet supplying a set of lighting units in series along a power cable. When the lighting units turn on, current will flow through cable, and due to copper resistance, there will be voltage drops along the cable. The voltage loss on the cable is not negligible, for example up to 10% voltage drop is expected. The voltage drops will influence the input voltage at each lighting unit location, so measured voltages at each lighting unit contain information of the physical cable connection.

Figure 1:
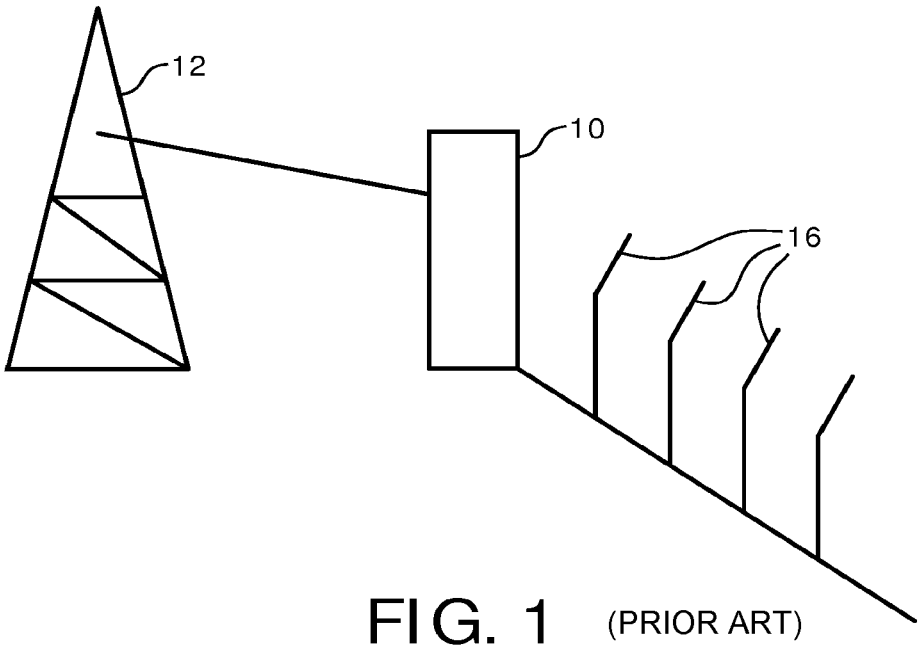
FIG. 1 (PRIOR ART)
FIG. 1 shows a typical lighting control system.
Figure 2:
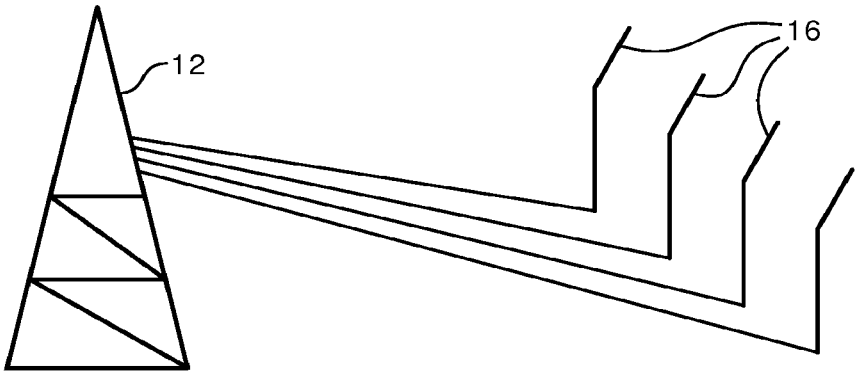
FIG. 2 (PRIOR ART)
FIG. 2 shows a lighting control system based on distributed individual control units.
Figure 3:
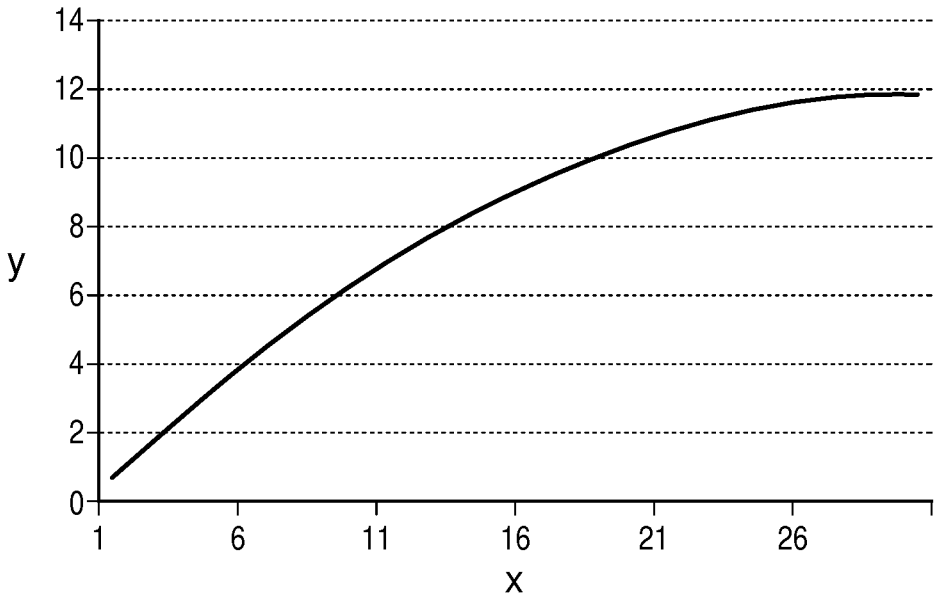
FIG. 3 shows how cable voltages vary along a cable having distributed lighting units.

For example, FIG. 3 relates to a lighting system with thirty 250 W lighting units, whose cable length between each lighting unit is 30 m, and with a cross sectional area of the cable of 23 $mm^2$ (0.75 Ohm/km). The voltage drop at each lighting unit is shown as the y-axis, and the lighting unit number is shown along the x-axis. Each lighting unit has a different voltage drop, and the longer the distance between the lighting unit and cabinet, the larger the voltage drop.

Figure 4:
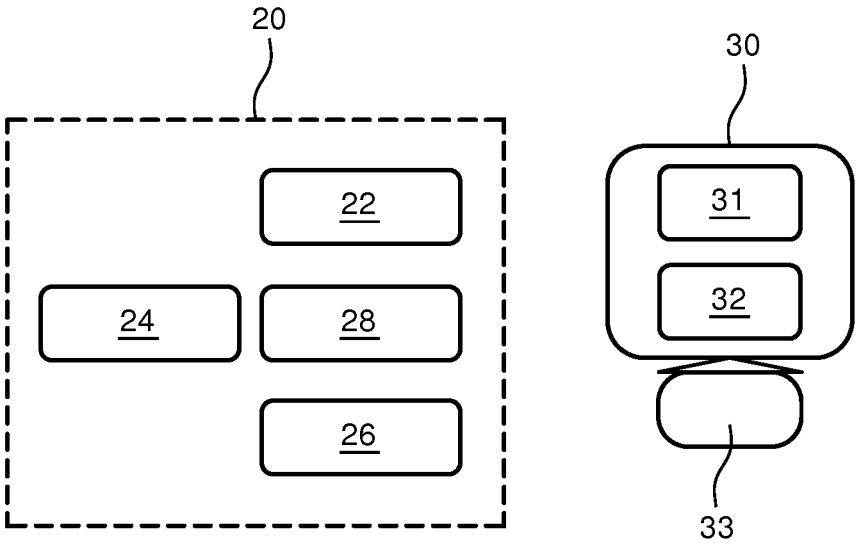
FIG. 4 shows the main elements to implement one example of the invention.

FIG. 4 shows the main elements to implement one example of the invention.

The lighting unit 20 performs a voltage sampling and communication function. The lighting unit comprises a voltage sampling module 22 which takes samples of the input voltage, from which an RMS voltage can be calculated. A satellite positioning module such as a GPS module 24 provides a precise geographical location of the lighting unit. The time can also be obtained from this unit.

A communications module 26 provides communication to the back end part 30 of the system. Any suitable communication technology can be used. Commands, voltage data and position data are transmitted via this module 26. In one embodiment, the voltage data and position data could be transmitted in a pair (voltage data, position data). Alternatively, voltage data and position data could be transmitted separately, each together with an identifier of the lighting unit 20, so that when the back end part 30 receives these data it could identify the voltage data and position data for each lighting unit 20.

The communication between the lighting units 20 and the back end 30 may for example be based on GPRS (General Packet Radio Service), 3G, 4G, ZigBee or PLC (Power Line Communication). The back end unit 30 comprises a receiving module 31 for receiving the information from the lighting units and a controller 32 which performs data collection and analysis.

A main controller unit 28 of the lighting unit 20 controls the timing of voltage sampling, and the data processing and transmission functions.

The data collection and analysis unit performed by the controller 32 is based on instructing all the individual lighting units to perform a voltage sampling operation and then performing data collection. By analysing the data, it locates non-lighting assets (cables and cabinets) and may for example display them using a user interface (UI) 33. Optionally, this analysis can be interactive, which can improve accuracy with manual assistance.

The user interface analysis algorithm can be based on a geographical information system (GIS) based, which shows asset location information, and enables human interactive commissioning.

Figure 5:
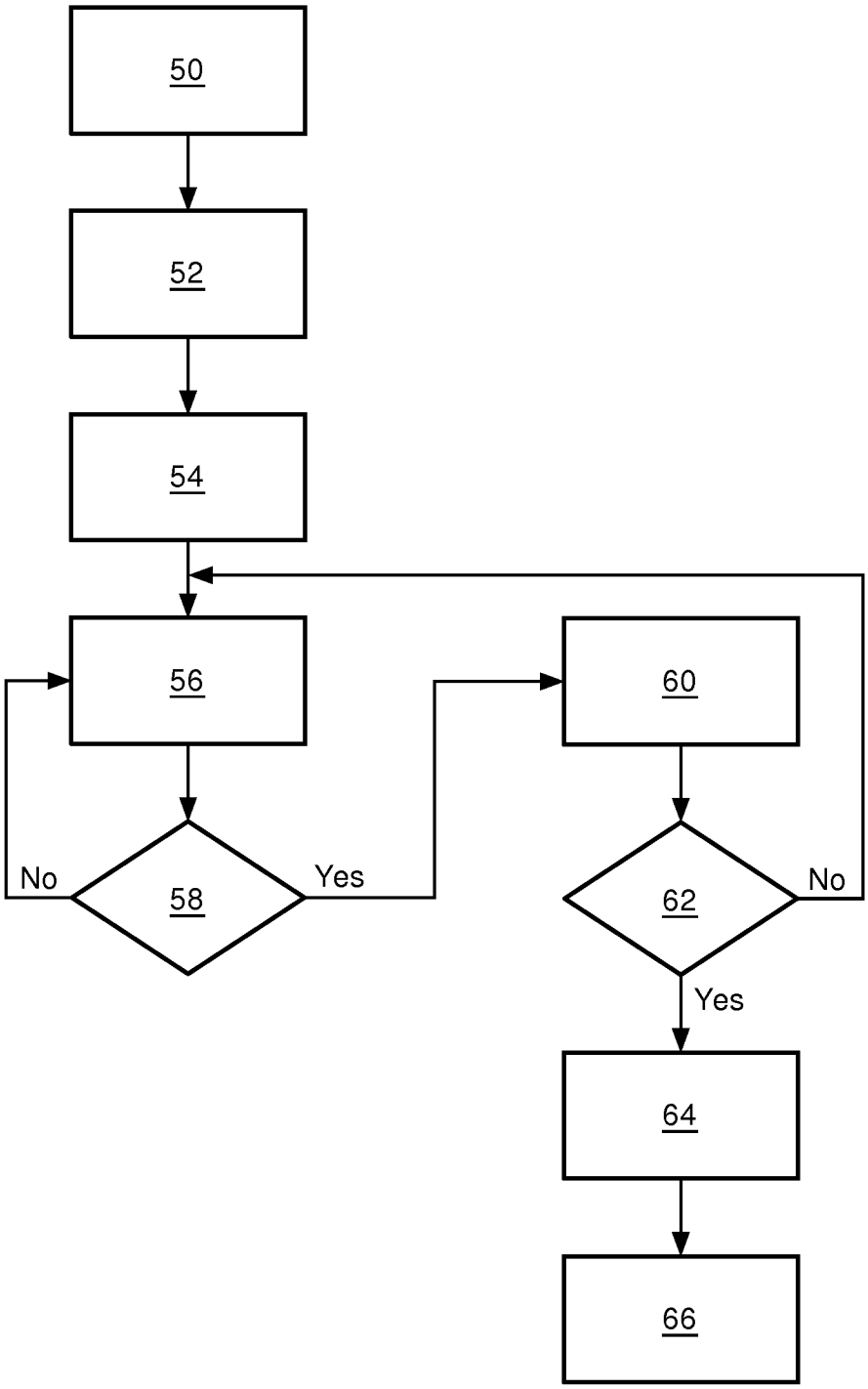
FIG. 5 shows the operating method as implemented by the individual lighting units.

FIG. 5 shows the operating method as implemented by the individual lighting units.

In step 50, the back end sends a commission command to the individual lighting units, which may be considered to comprise individual control nodes. This command is received in the lighting unit in step 52.

The command indicates when the voltage sampling operation is to start (for example 8:00 pm), and indicates how many samples are needed, as shown in step 54.

After the command is received, the controller inside the lighting unit checks the time, for example using the GPS module or a real time clock (RTC) module, to make sure that the sampling time for all lighting units is aligned. This involves reading the time in step 56 and checking if the time is right in step 58 in a repeating process until the allocated time is reached.

In step 60 at the appropriate time, the instructed number of voltage samples are measured, by repeated measurements until the correct number has been made, as determined in step 62. Step 62 checks if enough samples have been read.

By turning all lights on during the voltage sampling, the current flow will result in maximum voltage drops, thus assisting the detection. This may be performed at the commissioning stage, with the back end sending a command to all the nodes to be turned on and powered to the maximum level. Alternatively, the sampling could be carried out when all nodes are on during normal use of the commissioned system, and they are at their maximum output level. However, the voltage sampling may also take place without ensuring the lighting units are turned on, as voltage drops will in any case arise along the cable lengths resulting from the voltage sampling function.

The sampling is carried out continuously for all the different lighting units, so that they are all at the same point in the AC cycle. The timing information thus enables all sampling information from different lighting units to be at the same point within the AC mains cycle. By taking a number of samples of the AC voltage, an RMS value can be obtained.

By way of example, the sampling may begin at the time when the voltage just crosses zero. Then, data is sampled following several AC cycles, for example at least 3 AC cycles. The sampling frequency may for example be 4800 Hz or higher.

The RMS voltage for each cycle is then calculated and uploaded. Use of RMS voltages is preferred, even though real time sampled voltage values could also be used to derive the network topology. However, the real time sampled voltage values might be disturbed by noise and may be not so accurate. To improve the voltage value accuracy, each light unit preferably calculates the RMS voltage based on hundreds of sampled voltage values.

In step 64 the lighting unit reads the geographical information from the GPS module. In step 66, the both the voltage information and the GPS information is sent to the back end.

Figure 6:
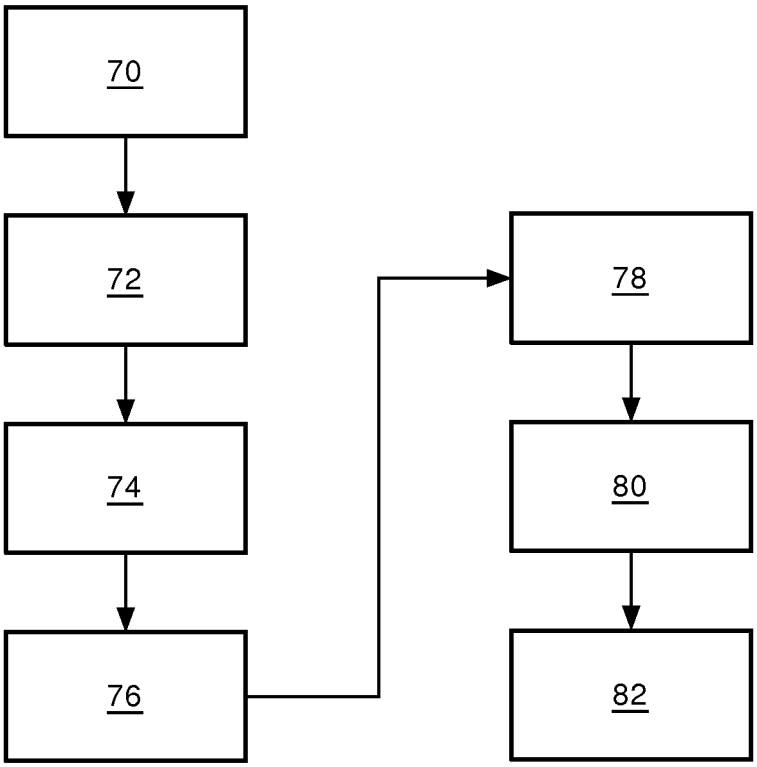
FIG. 6 shows the operating method as implemented by the back end controller.

FIG. 6 shows the operating method as implemented by the back end controller.

In step 70, the back end controller sends the commissioning command. In step 72 the back end waits and receives the sampled voltage information and positioning information from all of the lighting units.

In step 74, the back end controller updates all of the voltage data and GPS information onto a digital map. The positioning data can be clustered based on different streets and roads since the cable paths will follow the roadside. This use of road locations is shown in step 76.

The voltage analysis involves finding the peak and the valley of the voltage distributions, in step 78. These peaks and valleys can also be represented graphically on the digital map. A voltage peak can be assumed to take place at the start of a cable, and a voltage valley can be assumed to take place at the terminal of a cable. Normally, the gathering of peaks is the location of cabinet, which supplies multiple cables.

The voltage analysis thus enables the locations of cables and cabinets to be identified as shown in step 80, and then displayed over the digital map as shown in step 82. The commissioner can manually change the automated results if required.

By gathering the voltage information and the geographical information of all lighting units, the physical cable connections can be located, for use in commissioning.

The road lighting cables are installed along roads, and the back end can cluster the lighting units based on different road names. This is realized using the geographical information and the digital map database. All the points close to one road can be clustered into one class, which suggests they might be supplied by one power cable.

Figure 7:
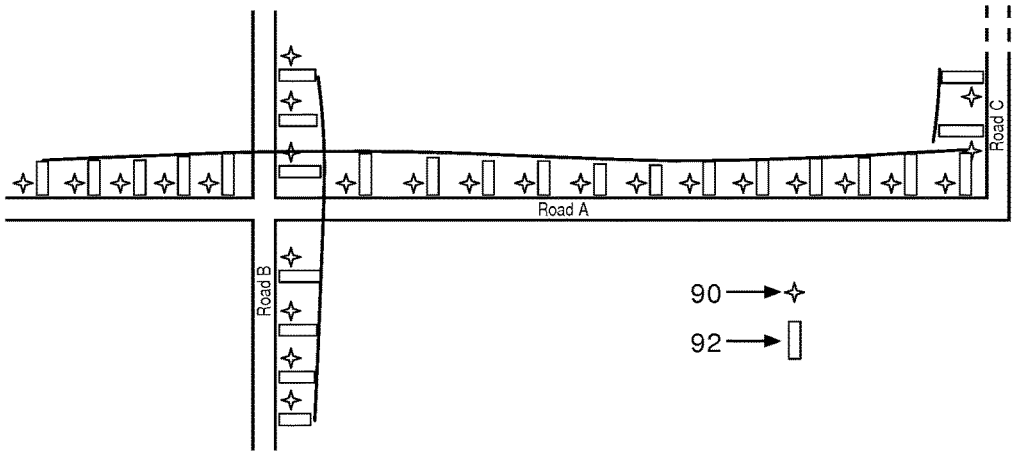
FIG. 7 shows the basic information as represented by a user interface overlaid over a digital map.

FIG. 7 shows the basic information as represented by the user interface 32 overlaid over a digital map.

Each lighting unit is represented by a star symbol 90 and the corresponding RMS voltage level is shown either graphically or numerically. This information is shown schematically by the rectangle 92.

The lighting units near to a cabinet suffer smaller voltage loss, whereas the lighting units far away from the cabinet suffer larger voltage loss, so the voltage loss is highly dependent on the cable length.

By finding the peak and valley of the measured RMS voltage at each lighting unit, the cable starting point and end terminal can be easily found.

Figure 8:
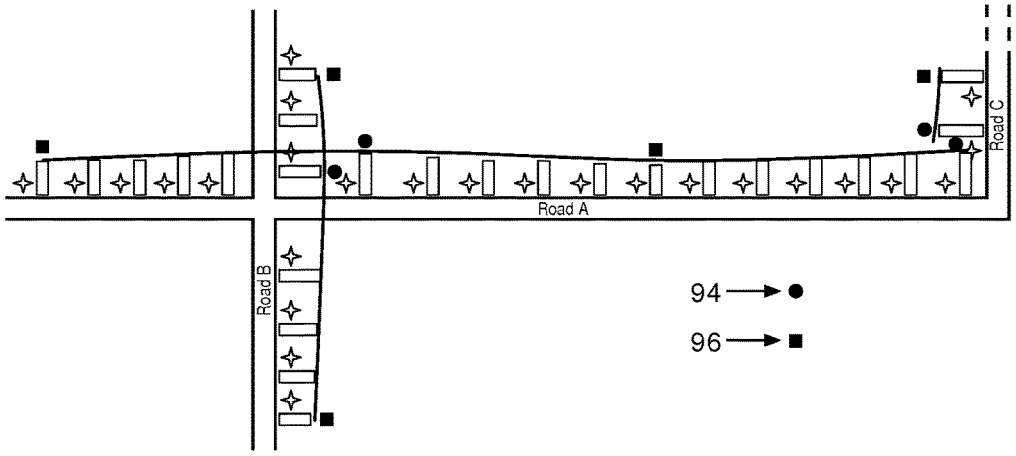
FIG. 8 shows the peak voltage information added to the image of FIG. 7.

FIG. 8 shows the peak voltage information added to FIG. 7 as circles 94 and the valley voltage information as squares 96.

In order to find the peak and valley points, a double differentiation algorithm may be applied. The pole voltages are named V1 . . . Vn. The double differentiation algorithm includes two differentiation steps:

The first differentiation steps gives:

$$dV_i\begin{cases}1 \text{ if } V_{i+1}>V_i\\ 0 \text{ if } V_{i+1}=V_i\\ -1 \text{ if } V_{i+1}<V_i\end{cases}$$

This provides a three level value indicating if the voltage to the next pole is increased, decreased or the same, compared to the previous pole.

The second differentiation gives:

$$ddV_i=dV_{i+1}-dV_i$$

If the value ddVi<0, then the (i+1)th pole is the peak point, and if the value ddVi>0, then the (i+1) the pole is the valley point.

In this way, all the lighting units between the nearby peak and valley points are connected by the same cable. The cable length can be readily estimated on the map using the GPS information, by calculating the distance between the peak and valley point. The cable direction (i.e. away from a cabinet at its source) is from the peak to the valley.

Figure 9:
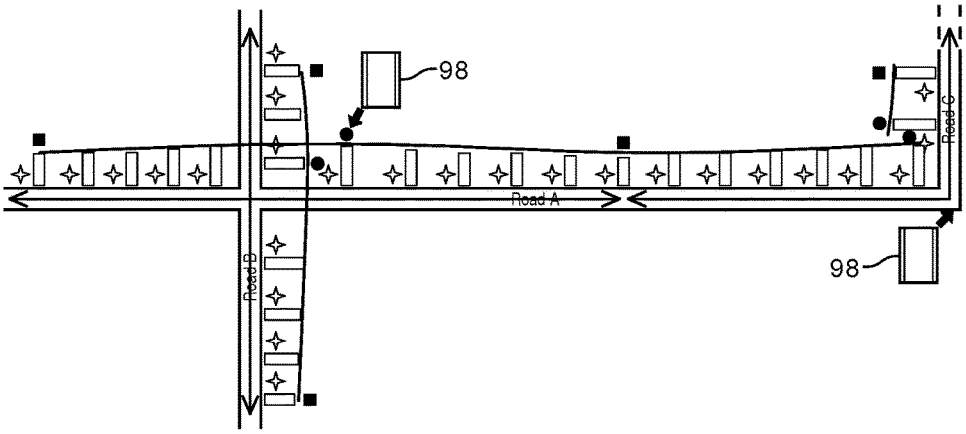
FIG. 9 shows the cabinet location information added to the image of FIG. 8.

If more than one voltage peak is gathered at one point on the map, this point can be identified as a power cabinet. The location of the cabinets 98 is illustrated in FIG. 9 added to the information in FIG. 8. Furthermore, the cable directions are represented by arrows, pointing away from the cabinet which is the source of the cable. The user of the system can drag and place these assets, and edit these properties using the user interface system, if the estimated location is known not to be correct.

After commissioning, these non-lighting assets can be managed in a database. Each lighting unit will be linked to its cable and cabinet, for example, lighting unit 1 is connected to cable 1 in cabinet 2 on Road A.

The description above makes clear the advantages of the system for commissioning a system.

The system and method can also be used for fault diagnosis. In daily operation and maintenance, the collected information can be used to aid in lighting failure diagnosis.

Figure 10:
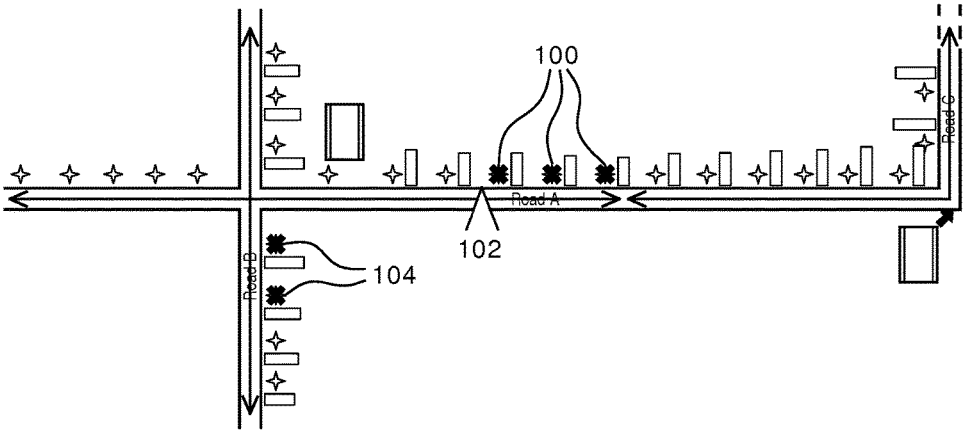
FIG. 10 shows how the system helps diagnose cable or lighting unit failure issues.

FIG. 10 shows how the system helps diagnose cable failure issues. Several nearby lighting units fail as shown as 100. By cross-checking the associated cable information, because the locations of the lighting units are at the terminal part of a cable, it can be diagnosed that the cable is broken at location 102. If the failed lighting units are in the middle of an associated cable, as shown by lighting units 104 it can be diagnosed that the problem relates to failure of the lighting units.

The lighting unit at the roadside includes a luminaire and an individual control unit. If the control unit is still working, failure of the luminaire can be detected and reported via the control unit. If both part fails (because of a power outage or a broken cable or a cabinet failure), the control unit is offline and cannot report the failure. In this case, the back end will automatically know the offline status, and can then use the method described above to help diagnose the potential issue.

All of these failures can be automatically investigated by the system.

Figure 11:
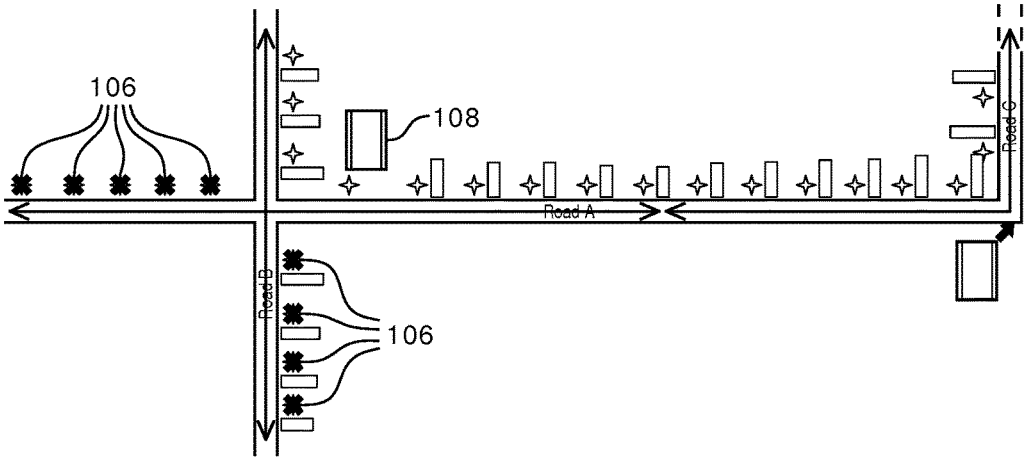
FIG. 11 shows how the system helps diagnose lighting cabinet failure issues.

FIG. 11 shows a large scale lighting failure in which many lighting units 106 have failed. Again, by cross checking the associated cabinet and cable information, if all the lighting units in one cable or cabinet fails, it can be diagnosed that something is wrong in the cabinet. Thus, two cables from cabinet 108 are not functioning.

This information enables maintenance teams to find problems and fix the lighting system in the field.

The example above has a network of cabinets and lighting units. The cabinets essentially represent the start point of power cables. The invention can be applied to a set of lighting units over a large area without any cabinets or without the need to identify cabinet locations. The linking of road map information to interpret cable routes is also not essential.

The examples above make use of a satellite positioning system to provide physical location information. However, the position information may be provided to the fault analysis system from other sources. For example the information may be taken from an external geographic information system (GIS). Positioning information may also be obtained based on mobile telephony network signals rather than satellite signals.

As a minimum, the system and method can be used for monitoring a set of lighting units associated with a shared supply cable. However, the invention is applicable to a whole network of supply cables and associated lighting units, as will be clear from the examples above.

The analysis of positioning information and voltage information which is performed in the back end can essentially be performed in software, which is run by a controller at the back end. The back end includes a computer for this purpose, which may comprise, but is not limited to, PCs, workstations, laptops, PDAs, palm devices, servers, storages, and the like.

Generally, in terms of hardware architecture, the computer may include one or more processors, memory, and one or more I/O devices that are communicatively coupled via a local interface. The local interface can be, for example but not limited to, one or more buses or other wired or wireless connections, as is known in the art. The local interface may have additional elements, such as controllers, buffers (caches), drivers, repeaters, and receivers, to enable communications. Further, the local interface may include address, control, and/or data connections to enable appropriate communications among the aforementioned components.

The processor is a hardware device for executing software that can be stored in the memory. The processor can be virtually any custom made or commercially available processor, a central processing unit (CPU), a digital signal processor (DSP), or an auxiliary processor among several processors associated with the computer, and the processor may be a semiconductor based microprocessor (in the form of a microchip) or a microprocessor.

The memory can include any one or combination of volatile memory elements (e.g., random access memory (RAM), such as dynamic random access memory (DRAM), static random access memory (SRAM), etc.) and nonvolatile memory elements (e.g., ROM, erasable programmable read only memory (EPROM), electronically erasable programmable read only memory (EEPROM), programmable read only memory (PROM), tape, compact disc read only memory (CD-ROM), disk, diskette, cartridge, cassette or the like, etc.). Moreover, the memory may incorporate electronic, magnetic, optical, and/or other types of storage media.

The software in the memory may include one or more separate programs, each of which comprises an ordered listing of executable instructions for implementing logical functions. The software in the memory includes a suitable operating system (O/S), compiler, source code, and one or more applications. Each application may be a source program, executable program (object code), script, or any other entity comprising a set of instructions to be performed.

The I/O devices may include input devices such as, for example but not limited to, a mouse, keyboard, scanner, microphone, camera, etc. Furthermore, the I/O devices may also include output devices, for example but not limited to a printer, display, etc.

The application or applications can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A method of monitoring a lighting system which comprises a plurality of lighting units positioned along at least a supply cable comprising:

obtaining physical location information in respect of each lighting unit;

receiving supply voltage information in respect of each lighting unit; and based on the physical location of each lighting unit and the supply voltage information, deriving power network information which identifies the cable routes between the lighting units;

wherein the step of deriving power network information comprises the following steps of:

clustering the lighting units based on their physical locations;

identifying the cable routes between the lighting units based on voltage information within each cluster.

2. A method as claimed in claim 1, wherein the power network information is derived based on the supply voltage information in respect of each lighting unit at the same time.

3. A method as claimed in claim 1, wherein the lighting system comprises a road lighting system.

4. A method as claimed in claim 3, wherein the power network information is obtained taking account of a map which identifies the road locations.

5. A method as claimed in claim 4, comprising diagnosis of a lighting cabinet failure, based on all lighting units along one or multiple cables from the lighting cabinet failing.

6. A method as claimed in claim 1, wherein the supply voltage information comprises a root mean square voltage calculated based on a number of samples of the AC voltage of each light unit.

7. A method as claimed in claim 1, wherein the system comprises a set of lighting cabinets, each lighting cabinet supplying at least one respective set of lighting units along a supply cable extending from the lighting cabinet, and wherein deriving power network information comprises identifying the lighting cabinet locations along the cable routes by analysis of the peaks and valleys of the supply voltages and the gathering of peaks is location of lighting cabinets.

8. A method as claimed in claim 1, further comprising providing a diagnosis of a cable failure, based on a set of lighting units at the end of a cable failing.

9. A method as claimed in claim 1, further comprising providing a diagnosis of a lighting unit failure, based on a lighting unit in a middle section of a cable failing.

10. A computer program product comprising computer program code means, which is adapted to perform a method of monitoring a lighting system which comprises a plurality of lighting units positioned along at least a supply cable when said program is run on a computer, the method comprising;

obtaining physical location information in respect of each lighting unit;

receiving supply voltage information in respect of each lighting unit; and based on the physical location of each lighting unit and the supply voltage information, deriving power network information which identifies the cable routes between the lighting units;

wherein deriving the power network information comprises:

clustering the lighting units based on their physical locations; and identifying the cable routes between the lighting units based on voltage information within each cluster.

11. A lighting system monitoring arrangement, for monitoring a lighting system which comprises a plurality of lighting units, wherein each lighting unit comprises a supply voltage monitoring system, wherein the monitoring arrangement comprises:

a receiving module for receiving a physical location of each lighting unit and for receiving supply voltage information from the supply voltage monitoring system; and a controller which is adapted to derive power network information, from the physical location information and the supply voltage information, which identifies the cable routes between the lighting units; and wherein the controller is further adapted to:

cluster the lighting units based on their physical locations;

identify the cable routes between the lighting units based on voltage information within each cluster.

12. A monitoring arrangement as claimed in claim 11, wherein the lighting system comprises a road lighting system, wherein the controller is adapted to take account of a map which identifies the road locations.

13. A monitoring arrangement as claimed in claim 11, wherein the lighting system comprises a set of lighting cabinets, each lighting cabinet supplying a respective set of lighting units along a supply cable extending from the lighting cabinet, and the controller is adapted to derive power network information which identifies the lighting cabinet locations along the cable routes by analysing the peaks and valleys of the supply voltage information and the gathering of peaks is location of lighting cabinets.

14. A monitoring arrangement as claimed in claim 11, wherein the controller is adapted to provide a diagnosis of:

a cable failure, based on a set of lighting units at the end of a cable failing; and/or a lighting unit failure, based on a lighting unit in a middle section of a cable failing and/or a lighting cabinet failure, based on all lighting units along one or multiple cables from the lighting cabinet failing.

15. A monitored lighting installation, comprising:

a lighting system comprising a plurality of lighting units, wherein each lighting unit comprises a physical location system and a supply voltage measuring system; and a lighting system monitoring arrangement for monitoring a lighting system which comprises a plurality of lighting units, wherein each lighting unit comprises a supply voltage monitoring system, wherein the monitoring arrangement comprises:

a receiving module for receiving a physical location of each lighting unit and for receiving supply voltage information from the supply voltage monitoring system; and a controller which is adapted to derive power network information, from the physical location information and the supply voltage information, which identifies the cable routes between the lighting units; and wherein the controller is further adapted to:

cluster the lighting units based on their physical locations;

identify the cable routes between the lighting units based on voltage information within each cluster.

* * * * *